US011440093B2

(12) United States Patent
Takahashi

(10) Patent No.: US 11,440,093 B2
(45) Date of Patent: Sep. 13, 2022

(54) COMPOSITE PARTICLE AND DUST CORE

(71) Applicant: TDK Corporation, Tokyo (JP)

(72) Inventor: Takeshi Takahashi, Tokyo (JP)

(73) Assignee: TDK Corporation, Tokyo (JP)

( * ) Notice: Subject to any disclaimer, the term of this patent is extended or adjusted under 35 U.S.C. 154(b) by 213 days.

(21) Appl. No.: 16/990,547

(22) Filed: Aug. 11, 2020

(65) Prior Publication Data

US 2021/0053115 A1 Feb. 25, 2021

(30) Foreign Application Priority Data

Aug. 21, 2019 (JP) ..... JP2019-151205
Jul. 6, 2020 (JP) ..... JP2020-116653

(51) Int. Cl.

| | |
|---|---|
| ***B22F 1/02*** | (2006.01) |
| ***H01F 1/147*** | (2006.01) |
| ***C22C 38/08*** | (2006.01) |
| ***C22C 38/02*** | (2006.01) |
| ***B22F 9/08*** | (2006.01) |
| ***B22F 1/00*** | (2022.01) |
| ***B22F 1/16*** | (2022.01) |
| ***B22F 1/142*** | (2022.01) |
| *H01F 27/255* | (2006.01) |

(52) U.S. Cl.

CPC ..... *B22F 1/16* (2022.01); *B22F 1/142* (2022.01); *B22F 9/082* (2013.01); *C22C 38/02* (2013.01); *C22C 38/08* (2013.01); *H01F 1/147* (2013.01); *B22F 2301/35* (2013.01); *B22F 2302/35* (2013.01); *H01F 27/255* (2013.01)

(58) Field of Classification Search

None

See application file for complete search history.

(56) References Cited

FOREIGN PATENT DOCUMENTS

| | | | |
|---|---|---|---|
| JP | 2019-033107 | A | 2/2019 |
| JP | 6477124 | B2 | 3/2019 |

*Primary Examiner* — Alexandre F Ferre

(74) *Attorney, Agent, or Firm* — Faegre Drinker Biddle & Reath LLP

(57) ABSTRACT

A composite particle of the present invention comprises a soft magnetic iron-based particle, a coating layer disposed on a surface of the soft magnetic iron-based particle, and a spherical nanopowder with at least a part thereof disposed inside of the coating layer. The coating layer is a layer of a compound comprising Fe, Si, O, B and N; and the nanopowder is a powder of a compound comprising O, N and at least one element selected from the group consisting of Fe, Si, Zr, Co, Al, Mg, Mn and Ni.

9 Claims, 2 Drawing Sheets

COMPOSITE PARTICLE AND DUST CORE

TECHNICAL FIELD

The present invention relates to a composite particle and a dust core.

BACKGROUND

Soft magnetic materials for use in electronic components such as inductors, reactors, choke coils and noise absorbers are required to have the surface of magnetic metal particles coated with a highly insulating material such as a phosphate and silica. For example, in Patent Literature 1, as the highly insulating coating film, an oxide-containing insulating film mainly composed of boron nitride is disclosed.

Also, in Patent Literature 2, formation of an electrically insulating ferrite layer on a surface of a soft magnetic metal particle and disposition of electrically insulating ferrite particles on the ferrite layer are disclosed.

CITATION LIST

Patent Literature

Patent Literature 1: Japanese Patent No. 6477124

Patent Literature 2: Japanese Unexamined Patent Publication No. 2019-33107

SUMMARY

Technical Problem

A dust core is required to have a high density and high electrical insulation between particles. It cannot be said, however, both of the high density and the high electrical insulation are sufficiently achieved in parallel by conventional methods. In general, in the case where a dust core is molded by pressing, the density of a molded product tends to increase with the decrease in the thickness of the coating. With an excessively thin coating, however, dielectric breakdown may be caused due to friction between powders during molding. In contrast, with an excessively thick coating, the density of the molded product decreases. A dust core, therefore, has a trade-off relation between the density and the electrical resistance of the molded product.

It is an object of the present invention, in light of these circumstances, to provide a composite particle from which a product having both of the high density and the high electrical insulation in parallel can be produced even when compression molded.

Solution to Problems

The composite particle of the present invention comprises a soft magnetic iron-based particle, a coating layer disposed on a surface of the soft magnetic iron-based particle, and a spherical nanopowder with at least a part thereof disposed inside of the coating layer.

The coating layer is a layer of a compound comprising Fe, Si, O, B and N; and the nanopowder is a powder of a compound comprising O, N and at least one element selected from the group consisting of Fe, Si, Zr, Co, Al, Mg, Mn and Ni.

The nanopowder may be a powder of a compound comprising Fe, Si, O and N.

Also, the coating layer may have an average thickness of 5 to 100 nm.

Also, the composite particle may have an oxygen content of 0.3 mass % or less.

Also, the composite particle may have a nitrogen content of 0.2 to 0.6 mass %.

Also, in an enlarged photograph of the surface of the composite particle, the proportion of the total area of the nanopowder may be 1 to 5% with respect to the area of the surface of the composite particle.

Also, the nanopowder may have an average particle size of 5 to 200 nm.

The soft magnet iron-based particle may comprise an oxidized region along an interface to the coating layer.

The dust core of the present invention comprises the composite particles described in any one of the items above.

Advantageous Effects of Invention

According to the present invention, a composite particle is provided from which a compression molded product having both of the high density and the high electrical insulation in parallel can be produced.

DETAILED DESCRIPTION (Composite Particle)

Figure 1:
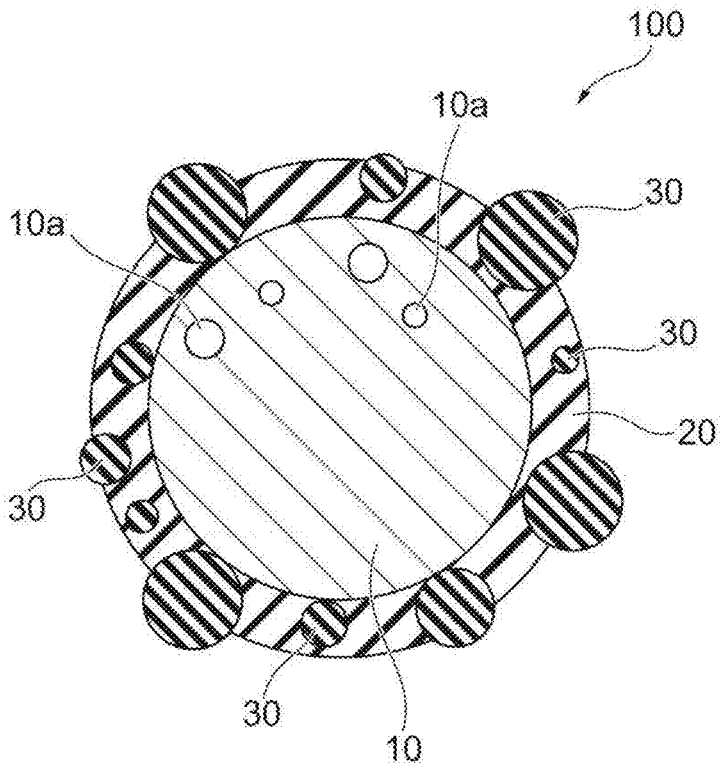
FIG. 1 is a schematic cross-sectional view showing a composite particle in an embodiment of the present invention.

The composite particle in an embodiment of the present invention is described with reference to FIG. 1.

A composite particle 100 in the present embodiment comprises a soft magnetic iron-based particle 10, a coating layer 20 disposed on the surface of the soft magnetic iron-based particle 10, and a nanopowder 30 disposed inside of the coating layer 20.

(Soft Magnetic Iron-Based Particle)

The soft magnetic iron-based particle 10 is a particle having soft magnetic properties, comprising Fe as an element having a largest atomic fraction among elements in the particle. The atomic fraction of Fe may be 50 atom % or more.

Examples of the soft magnetic iron-based material include a pure iron, a carbonyl iron, an Fe—Si alloy, an Fe—Al alloy, an Fe—N compound, an Fe—Ni alloy, an Fe—C compound, an Fe—B compound, an Fe—Co alloy, an Fe—Al—Si alloy, an Fe—Al—Cr alloy, an Fe—Al—Mn alloy, an Fe—Al—Ni alloy, an Fe—Si—Cr alloy, an Fe—Si—Mn alloy, and an Fe—Si—Ni alloy. The soft magnetic iron-based material may be a crystalline material, an amorphous material, or a nanocrystalline material.

The particle size of the soft magnetic iron-based particle 10 is not particularly limited, and may be 1 to 100 μm. The lower limit of the particle size may be 3 μm or 5 μm. The upper limit may be 50 μm or 30 μm.

The particle size of the soft magnetic iron-based particle 10 means the average particle size D50 in a volume-based particle size distribution measured by a laser diffraction particle size distribution measurement apparatus (HELOS or the like).

It is preferable that the circularity of the cross section of the soft magnetic iron-based particle 10 be 0.80 or more. By increasing the circularity, the proximal points between the soft magnetic iron-based particles 10 decrease, so that the electrical insulation tends to be easily secured.

The circularity in the present specification is Wadell's circularity. The circularity is defined as, in the cross section of a particle, the ratio of the diameter of a circle having an area equal to that of the particle relative to the diameter of a circle circumscribed to the particle. A perfect circle has a Wadell's circularity of 1. As Wadell's circularity approaches 1, the roundness increases; and with a Wadell's circularity of 0.80 or more, an approximately spherical appearance can be obtained. In observation of the cross section, an image obtained from an optical microscope, SEM, TEM, or the like can be used; and in calculation of the circularity, image analysis may be employed.

Incidentally, the soft magnetic iron-based particle 10 may have one or a plurality of oxidized regions 10*a* inside, along an interface to the coating layer 20. For example, the oxidized region 10*a* may have a spherical shape. The diameter of the oxidized region 10*a* may be 1 to 20 nm. The diameter may be measured in the same manner as in the case of the diameter of nanopowder described below. Since the soft magnetic iron-based particle 10 includes the oxidized region 10*a* inside, the electrical resistivity increases and the eddy current loss in the particle is reduced. With a diameter of the oxidized region 10*a* of less than 1 nm, the effect of reducing the eddy current loss decreases. With a diameter of the oxidized region of more than 20 nm, the magnetic permeability tends to decrease.

(Coating Layer)

The coating layer 20 covers the surface of the soft magnetic iron-based particle 10. It is preferable that the coating layer 20 cover the entire surface of the soft magnetic iron-based particle 10.

The coating layer 20 may have an average thickness of 1 nm or more, preferably 5 nm or more. The coating layer 20 may have an average thickness of 100 nm or less, preferably 50 nm or less. With an excessively large thickness of the coating layer 20, the density after compression molding tends to decrease, while with an excessively small thickness, contact between the soft magnetic iron-based particles 10 in compression molding may be caused in some cases. The average thickness of the coating layer 20 may be an arithmetic mean of the thickness measured at 10 points disposed at equal intervals along the interface between the coating layer and the soft magnetic iron-based particle in a cross-sectional photograph.

The coating layer is a layer having an electrical insulation, made of a compound comprising at least Fe, Si, O, B and N. Thus, the adhesion to the soft magnetic iron-based particle 10 is enhanced, and insulation increases.

The composite particle 100 may have an oxygen content of 0.3 mass % or less. With a high oxygen content, the composite particle tends to be hardened, so that the density is hardly increased.

The composite particle 100 may have a nitrogen content of 0.2 to 0.6 mass %. With a small nitrogen content, the thickness of the coating layer tends to be insufficient, so that the electrical resistance may decrease in some cases. With an excessively large nitrogen content, the thickness of the coating layer tends to be thick, so that the density is hardly increased.

(Nanopowder)

At least a part of the individual particle constituting the nanopowder 30 is disposed inside of the coating layer 20. In other words, a distance R between the individual particle of the nanopowder 30 and the soft magnetic iron-based particle 10 is smaller than the average thickness D of the coating layer 20. R may be D/2 or less, or may be 0. In a typical case, a part of the particle constituting the nanopowder 30 is disposed inside of the coating layer 20, and the remaining part is exposed from the coating layer 20. A part of the particle constituting the nanopowder 30 may be completely embedded inside of the coating layer 20.

The shape of the nanopowder 30 is spherical. Being in a spherical shape means that the nanopowder has a Wadell's circularity of 0.8 or more in an electron microscopic photograph (e.g., TEM) of a cross section of the composite particle. Wadell's circularity is defined as the ratio of the diameter of a circle having an area equal to the area of the particle relative to the diameter of a circle circumscribed to the particle. In the measurement of the circularity, the arithmetic mean of the circularity of about 30 pieces of nanoparticles may be taken.

The nanopowder 30 has an average particle size of 200 nm or less. The upper limit of the average particle size may be 200 nm or 150 nm, being preferably 80 nm. The lower limit of the average particle size is not particularly specified, and may be 1 nm, being preferably 5 nm. The particle size of the nanopowder 30 is the equivalent diameter of an equal-area circle in an electron microscopic photograph (e.g., TEM) of the cross section of the composite particle, and the average particle size may be the arithmetic mean of the particle size of about 30 pieces of the nanoparticles.

It is preferable that the average particle size d of the nanopowder 30 be larger than the average thickness t of the coating layer 20. The value of d/t may be 1.5 or more, 2 or more, 2.5 or more, or 3 or more.

The nanopowder 30 is a powder of a compound comprising O, N and at least one element selected from the group consisting of Fe, Si, Zr, Co, Al, Mg, Mn and Ni. Since the nanopowder 30 is an oxynitride of metal and/or metalloid elements, the electrical insulation and the toughness are secured, which is desirable. In particular, due to containing N, the toughness is improved in comparison with an oxide, so that the contact between the soft magnetic iron-based particles is more easily inhibited even when compressed.

It is preferable that the nanopowder 30 be a powder of a compound comprising Fe, Si, O and N. Since the nanopowder 30 is a compound comprising Fe and Si, magnetism is further exhibited, so that magnetic properties such as magnetic permeability are more improved.

In an enlarged photograph (e.g., SEM) of the surface of a composite particle 100, the proportion of the total area of the individual particles of the nanopowder 30 may be 1 to 5% with respect to the area of the surface of the composite particle 100.

It is preferable that the area of the surface of the particle be set to 5 $\mu m^2$ to 15 $\mu m^2$.

With a proportion of the area of the nanopowder 30 of less than 1%, the soft magnetic iron-based particles 10 tend to be easily contacted to each other. With a proportion of the area of the nanopowder 30 of more than 5%, the density is hardly increased.

(Effect)

In the composite particle in the present embodiment, the coating layer 20 with electrical insulation has a specific composition, so that the adhesion between the coating layer 20 and the soft magnetic iron-based particle 10 is enhanced. As a result, even when the composite particles are subjected to compression molding for increase in the density, the coating layer 20 easily maintains the electrical insulation between the soft magnetic iron-based particles 10. Also, since the nanopowder 30 is disposed inside of the coating layer 20, the coating layer 20 is hardly peeled off due to the nanopowder 30 during compression molding. Further, since the nanopowder comprises N (nitrogen) in addition to O (oxygen), toughness is also enhanced in addition to electrical insulation, so that the contact between the soft magnetic iron-based particles 10 in compression molding is further inhibited.

(Method for Manufacturing Composite Particle)

Subsequently, an example of the method for manufacturing the composite particle is described.

First, the case where an Fe—Si alloy particle is used as the soft magnetic iron-based particle is described. An Fe—Si alloy particle as the soft magnetic iron-based particle 10 and a BN (boron nitride) particle are prepared.

As the Fe—Si alloy particle, for example, a particle having a high circularity obtained by gas atomization process is preferably used. The particle size is as described above.

It is preferable that the BN powder have an average particle size of 20 nm to 4 μm. It is preferable that the BN be a hexagonal crystal (h-BN). The average particle size of the BN powder is D50 of the volume-based particle size distribution measured by wet laser diffraction/dispersion method.

Next, the soft magnetic iron-based particle 10 and the BN powder are mixed to obtain a mixture powder. In mixing, various mixing machines such as a V-type mixing machine, a W-type mixing machine, a drum-type mixing machine, a high-speed mixer, a ribbon-type mixing machine, a conical screw mixing machine, an FM mixer, a high-speed flow mixing machine, an air blender, a rocking mixer, an SPEX mixer and a mixing shaker may be used.

Subsequently, the mixture powder is heat treated in a nitrogen atmosphere at 800 to 1100° C., preferably 900 to 1000° C., so that a coating layer 20 comprising Fe, Si, O, B and N, and many nanopowders 30 comprising Fe, Si, O and N disposed inside of the coating layer 20 can be formed. Also, an oxidized region 10*a* may be formed on this occasion in some cases.

The heat treatment time is not particularly limited, and may be 30 minutes to 6 hours.

Incidentally, at a heat treatment temperature of about 400 to 700° C., no nanopowder is formed, while the coating layer comprising Fe, Si, O, B and N is formed. Accordingly, in this case, with addition of a nanopowder comprising O, N and at least one element selected from the group consisting of Fe, Si, Zr, Co, Al, Mg, Mn and Ni to the mixture powder in advance, the composite particle comprising a coating layer and a spherical nanopowder in the present embodiment is able to be obtained.

In the case where the soft magnetic iron-based particle 10 contains no Si, an Si-source compound such as tetraethyl orthosilicate and a silane coupling agent may be added to the mixture powder to form the coating layer 20.

The composite particle is then washed with an organic solvent such as alcohol on an as needed basis to remove unreacted BN powder and the like attached to the composite particle. The solvent is then dried, so that the composite particle for use in compression molding can be obtained.

(Dust core)

The dust core in an embodiment of the present invention comprises the composite particles described above. The dust core may include a binder which binds the composite particles to each other, besides the composite particles. Examples of the binder include an epoxy resin, a phenol resin, a polyamide resin, and a silicone resin. A silicone resin is particularly preferred from the viewpoint of heat resistance. These resins may be a thermosetting resin. The space between the composite particles are filled with the binder. The binder may be made of resin as it is, or at least a part or all of the binder may be made of a thermally decomposed product of the resin. The mixing ratio of the binder is not particularly limited, and the binder content may be 0.05 to 2.00 mass % relative to the mass of the composite particles.

The shape of the dust core is not particularly limited. For example, a cylindrical core, a toroidal (ring-shaped) core, a cut core having an E-shape, U-shape, etc., or a core for motors may be employed.

(Method for Manufacturing Dust Core)

A method for manufacturing a dust core is described based on a cylindrical core as an example.

First, the composite particles and a required amount of binder raw material are mixed. In the case where a solvent is added to the binder raw material, it is preferable the solvent be dried after mixing.

Subsequently, a lubricant is mixed into the composite particles including the binder raw material. Examples of the lubricant include zinc stearate. The lubricant content is not particularly limited, and may be 0.01 to 0.5 mass % relative to the composite particles.

Next, a mold having a void corresponding to the cylindrical core is filled with the mixture powder of the lubricant, the binder raw material, and the composite particles, and compression molding is performed to obtain a dust core in a desired shape. It is preferable that the lubricant be also applied to the inner surface of the mold in advance.

The pressure in compression molding is not particularly limited, and may be 981 to 1570 MPa.

After compression molding or during compression molding, heating may be performed to cure the binder raw material and/or anneal the soft magnetic iron-based particle on an as needed basis.

EXAMPLES

Manufacturing of Composite Particle

Example 1

A gas atomized Fe—Si (4.5 mass %) alloy powder having a particle size of 5 μm and a BN powder having a particle size of 4 μm were prepared. The Fe—Si alloy powder and the BN powder were mixed at a weight ratio of 5:1 to obtain a powder mixture.

Next, the powder mixture was placed in a crucible to be heat treated in a nitrogen atmosphere at 900° C. for 30 minutes, so that a composite particle was obtained with a coating layer of a compound containing B, O, N, Fe and Si formed on the surface of the Fe—Si alloy powder, and a nanopowder of a compound containing O, N, Si and Fe disposed inside of the coating layer.

Alcohol was supplied to the composite particle to wash the unreacted BN powder away from the composite particle, and then dried to obtain a composite particle in Example 1.

Example 2

A composite particle in Example 2 was obtained in the same manner as in Example 1, except that the weight ratio of the Fe—Si alloy powder to the BN powder was controlled to 100:1.

Example 3

A composite particle in Example 3 was obtained in the same manner as in Example 1, except that the weight ratio of the Fe—Si alloy powder to the BN powder was controlled to 1:1.

Comparative Example 1

A composite particle in Comparative Example 1 was obtained in the same manner as in Example 1, except that in addition to the Fe—Si alloy powder and the BN powder in Example 1, an amorphous MgO powder having an average particle size of 700 nm was mixed at a weight ratio of 50:10:1, and the heat treatment temperature was set to 500° C. Due to the low heat treatment temperature, although a coating layer of a compound containing B, O, N, Fe and Si was formed on the surface of the Fe—Si alloy powder, an MgO nanopowder was disposed in the coating layer without formation of the nanopowder of a compound containing O, N, Si and Fe.

Comparative Example 2

The Fe—Si alloy powder in Example 1 alone was placed in a crucible without addition of the BN powder, and heat treatment was performed in a nitrogen atmosphere at 900° C. for 30 minutes, so that a nanopowder of a compound containing O, N, Si and Fe was formed on the surface of the Fe—Si alloy powder without formation of a coating layer on the surface of the Fe—Si alloy powder. Next, to the Fe—Si powder having the nanopowder on the surface, an alcohol solution containing 1 wt % of phosphoric acid relative to the weight of the Fe—Si powder was supplied, and alcohol was then dried, so that the an iron phosphate coating layer having the nanopowder inside was formed on the surface of the Fe—Si alloy powder, to thereby obtain a composite particle in Comparative Example 2.

Comparative Example 3

A composite particles in Comparative Example 3 was obtained in the same manner as in Example 1, except that although a coating layer of a compound containing B, O, N, Fe and Si was formed on the surface of the Fe—Si alloy powder at a heat treatment temperature of 500° C., no nanopowder of a compound containing O, N, Si and Fe was formed on the surface of the Fe—Si alloy powder, then the BN powder was washed away from the Fe—Si alloy powder having the coating layer with alcohol, and then a spherical nanopowder of silica was mixed with the surface of the Fe—Si alloy powder to attach it on (outside of) the coating layer of the Fe—Si alloy powder.

Example 4

A gas atomized Fe—Ni (47.0 mass %)—Si (1.0 mass %) alloy powder having a particle size of 5 μm and a BN powder having a particle size of 4 μm were prepared. The Fe—Ni—Si alloy powder and the BN powder were mixed at a weight ratio of 5:1 to obtain a powder mixture.

Next, the powder mixture was placed in a crucible, and a heat treatment in a nitrogen atmosphere at 900° C. for 30 minutes was performed, so that a composite particle was obtained with a coating layer of a compound containing B, O, N, Fe and Si formed on the surface of the Fe—Ni—Si alloy powder, and a nanopowder of a compound containing O, N, Si and Fe disposed inside of the coating layer.

Alcohol was supplied to the composite particle to wash the unreacted BN powder away from the composite particle, and then dried to obtain the composite particle in Example 4.

Comparative Example 4

A composite particles in Comparative Example 4 was obtained in the same manner as in Example 4, except that in addition to the Fe—Ni—Si alloy powder and the BN powder in Example 4, an amorphous MgO powder having an average particle size of 700 nm was mixed at a weight ratio of 50:10:1, and the heat treatment temperature was set to 500° C. Due to the low heat treatment temperature, although a coating layer of a compound containing B, O, N, Fe and Si was formed on the surface of the Fe—Ni—Si alloy powder, an MgO nanopowder was disposed in the coating layer without formation of the nanopowder of a compound containing O, N, Si and Fe.

Comparative Example 5

The Fe—Ni—Si alloy powder in Example 4 alone was placed in a crucible without addition of BN powder, and heat treatment was performed in a nitrogen atmosphere at 900° C. for 30 minutes, so that a nanopowder of a compound containing O, N, Si and Fe was formed on the surface of the Fe—Ni—Si alloy powder without formation of a coating layer on the surface of the Fe—Ni—Si alloy powder. Next, to the Fe—Ni—Si powder having the nanopowder on the surface, an alcohol solution containing 1 wt % of phosphoric acid relative to the weight of the Fe—Ni—Si powder was supplied, and alcohol was then dried, so that the an iron phosphate coating layer having the nanopowder inside was formed on the surface of the Fe—Ni—Si alloy powder, to thereby obtain a composite particle in Comparative Example 5.

Comparative Example 6

A composite particles in Comparative Example 6 was obtained in the same manner as in Example 4, except that although a coating layer of a compound containing B, O, N, Fe and Si was formed on the surface of the Fe—Ni—Si alloy powder at a heat treatment temperature of 500° C., no nanopowder of a compound containing O, N, Si and Fe was formed on the surface of the Fe—Ni—Si alloy powder, then the BN powder was washed away from the Fe—Ni—Si alloy powder having the coating layer with alcohol, and then a spherical nanopowder of silica was mixed with the surface of the Fe—Ni—Si alloy powder to attach it on (outside of) the coating layer of the Fe—Ni—Si alloy powder.

(Sample Preparation)

To each of the composite particles in Examples 1 to 3 and Comparative Examples 1 to 3, a silicone resin was added to 1 wt %, mixed and dried. To the dried product, a lubricant (zinc stearate) was added to 0.05 wt % and further mixed. A mold having an inner diameter of 8 mm was filled with 1 g of the final mixture, from which a molded product was made by pressing at a molding pressure of 1570 MPa. The molded product was then heat-treated in a nitrogen atmosphere at 900° C. for 30 minutes to obtain a circular cylindrical core having a diameter of 8 mm. The density and the electrical resistance of the cylindrical core were measured as follows.

To each of the composite particles in Example 4 and Comparative Examples 4 to 6, a silicone resin was added to 1 wt %, mixed and dried. To the dried product, a lubricant (zinc stearate) was added to 0.05 wt % and further mixed. A mold having an inner diameter of 8 mm was filled with 1 g of the final mixture, from which a molded product was made by pressing at a molding pressure of 1180 MPa. The molded product was then heat-treated in a nitrogen atmosphere at 600° C. for 30 minutes to obtain a circular cylindrical core having a diameter of 8 mm. The apparent density and the electrical resistance of the cylindrical core were measured as follows.

Incidentally, the apparent density of a dust core changes depending on not only the packing factor but also the composition of metal and metalloid elements in the composite particle, so that it is difficult to compare the performance by the apparent density of the dust core in the case of different soft magnetic iron-based materials. Accordingly, as an index relating to the density not depending on the composition of metal and metalloid elements, the following packing factor was employed.

The packing factor (A (%)) is calculated based on a ratio of the apparent density (C) of a dust core relative to the true density (B) calculated based on the composition of metal and metalloid elements contained in the dust core, i.e., ($A=C/B\times100$).

The true density (B) is calculated from the sum of products of the mass ratio of metal and metalloid elements contained in the dust core and the density of each of the elements. For example, in Examples and Comparative Examples described above, the calculation is as follows.

In the case of Fe (95.5 mass %)—Si (4.5 mass %) alloy particle in Examples 1 to 3 and Comparative Examples 1 to 3, the true density (B) is as follows: $(7.87\times(100.0-4.5)+2.33\times4.5)/100=7.62$ g/cm$^3$.

In the case of Fe (52.0 mass %)—Ni (47.0 mass %)—Si (1.0 mass %) alloy particle in Example 4 and Comparative Examples 4 to 6, the true density (B) is as follows: $(7.87\times(100.0-47.0-1.0)+8.90\times47.0+2.33\times1.0)/100=8.30$ g/cm$^3$.

The density of the circular cylindrical core (dust core) was calculated by measurement of the weight and dimensions. In measurement of the electrical resistivity, the resistance between both of the mirror-finished surfaces of the cylindrical core having a diameter of 8 mm at 0.05 V using an IR meter R8340 manufactured by ADVANYEST. The electrical resistivity was then calculated from the thickness of the sample and the resistance. In the case where the soft magnetic iron-based particle is an Fe—Si alloy particle, it is preferable that the electrical resistivity be 2.5 kΩ·m or more, and the density be 6.7 g/cm$^3$ or more (packing factor: 88% or more). In the case where the soft magnetic iron-based particle is an Fe—Ni—Si alloy particle, it is preferable that the electrical resistivity be 2.5 kΩ·m or more, and the density be 7.3 g/cm$^3$ or more (packing factor: 88% or more). In other words, it is preferable that the electrical resistivity be 2.5 kΩ·m or more, and the packing factor be 88% or more.

The conditions and the results are shown in Table 1. Incidentally, the oxygen content and the nitrogen content in the composite particle were confirmed by impulse heating and melting extraction method using an oxygen/nitrogen analyzer TC600 manufactured by LECO. A graphite crucible containing Sn and graphite powder was used, and about 100 mg of a sample in an Ni capsule was precisely weighed to an accuracy of 0.1 mg to prepare a measurement sample.

The composition and the film thickness of the coating layer, the composition, the location, the shape, and the particle size of the nanoparticle were confirmed by STEM analysis of a cross section. The composite particle was embedded in a resin, and a thin sample was prepared by FIB "NOVA 200i" manufactured by FEI Company Japan, Ltd., so as to be observed by STEM-EDS "JEM2100FCS" manufactured by JEOL. The compositions of the coating layer and the nanoparticle were confirmed by line analysis and point analysis using STEM-EDS. The thickness of the coating layer was measured at 10 points to obtain an average. The shape and the particle size of the nanoparticle were calculated by measurement of the circularity and the average particle size of a TEM image using a freeware QMP (ver. 2. 0. 1).

The ratio of the area of the nanopowder relative to the area of the composite particle was calculated by observing the surface of the composite particle using FE-SEM "SU5000" manufactured by Hitachi High-Tech Corporation and analyzing the SEM image (magnification: 50 k) using a freeware QMP (ver. 2. 0. 1).

In Tables 1 and 2, the conditions and the results are shown. Incidentally, "inside of coating layer" means that at least a part of the particle of nanopowder is disposed inside of the coating layer, while "outside of coating layer" means the particle of nanopowder is disposed completely outside of the coating layer.

TABLE 1

| | Soft magnetic iron-based material Mass composition | Coating layer | | Nanopowder | | | |
|---|---|---|---|---|---|---|---|
| | | Composition | Thickness (nm) | Composition | Location | Average particle size (nm) | Particle shape (circularity) |
| Example 1 | Fe—4.5Si | B, O, N, Fe, Si | 25 | O, N, Si, Fe | Inside of coating layer | 80 | 0.91 |
| Example 2 | Fe—4.5Si | B, O, N, Fe, Si | 5 | O, N, Si, Fe | Inside of coating layer | 30 | 0.91 |
| Example 3 | Fe—4.5Si | B, O, N, Fe, Si | 50 | O, N, Si, Fe | Inside of coating layer | 180 | 0.91 |
| Comparative Example 1 | Fe—4.5Si | B, O, N, Fe, Si | 5 | MgO | Inside of coating layer | 700 | 0.21 |
| Comparative Example 2 | Fe—4.5Si | P, O, Fe | 30 | O, N, Si, Fe | Inside of coating layer | 80 | 0.91 |
| Comparative Example 3 | Fe—4.5Si | B, O, N, Fe, Si | 23 | $SiO_2$ | Outside of coating layer | 50 | 0.95 |
| Example 4 | Fe—47.0Ni—1.0Si | B, O, N, Fe, Si | 30 | O, N, Si, Fe | Inside of coating layer | 90 | 0.90 |

TABLE 1-continued

| | Soft magnetic iron-based material Mass composition | Coating layer Composition | Coating layer Thickness (nm) | Nanopowder Composition | Nanopowder Location | Nanopowder Average particle size (nm) | Nanopowder Particle shape (circularity) |
|---|---|---|---|---|---|---|---|
| Comparative Example 4 | Fe—47.0Ni—1.0Si | B, O, N, Fe, Si | 5 | MgO | Inside of coating layer | 700 | 0.22 |
| Comparative Example 5 | Fe—47.0Ni—1.0Si | P, O, Fe | 35 | O, N, Si, Fe | Inside of coating layer | 80 | 0.91 |
| Comparative Example 6 | Fe—47.0Ni—1.0Si | B, O, N, Fe, Si | 23 | $SiO_2$ | Outside of coating layer | 50 | 0.95 |

TABLE 2

| | Composite particle: Ratio of area of nanopowders relative to area of composite particle (%) | Composite particle: Oxygen content (mass %) | Composite particle: Nitrogen content (mass %) | Dust core: Apparent density ($g/cm^3$) | Dust core: Packing factor (%) | Dust core: Electrical resistance ($\Omega \cdot m$) |
|---|---|---|---|---|---|---|
| Example 1 | 2.2 | 0.212 | 0.237 | 6.817 | 89 | 1.8E+06 |
| Example 2 | 1.1 | 0.205 | 0.227 | 6.843 | 90 | 3.0E+03 |
| Example 3 | 4.8 | 0.241 | 0.561 | 6.735 | 88 | 1.4E+07 |
| Comparative Example 1 | 3.4 | 0.409 | 0.102 | 6.762 | 89 | 6.8E+00 |
| Comparative Example 2 | 2.1 | 0.722 | 0.013 | 6.598 | 87 | 1.5E+02 |
| Comparative Example 3 | 1.7 | 0.323 | 0.239 | 6.630 | 87 | 5.9E+04 |
| Example 4 | 2.4 | 0.211 | 0.331 | 7.380 | 89 | 1.9E+05 |
| Comparative Example 4 | 3.5 | 0.432 | 0.092 | 7.142 | 86 | 2.8E+00 |
| Comparative Example 5 | 2.3 | 0.953 | 0.008 | 7.088 | 85 | 1.4E+01 |
| Comparative Example 6 | 1.8 | 0.364 | 0.211 | 7.009 | 84 | 2.8E+02 |

Figure 2:
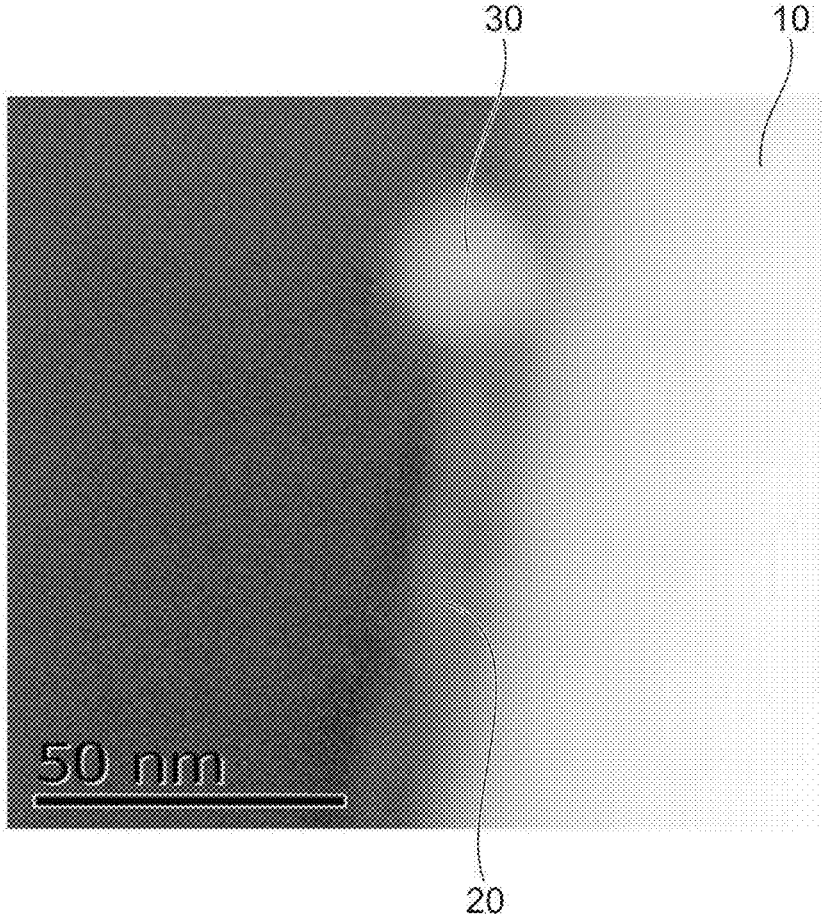
FIG. 2 is a TEM photograph of a cross section near the surface of the composite particle in Example 1.

In FIG. 2, a TEM cross sectional view in the vicinity of the surface of the composite particle in Example 1 is shown.

In Examples 1 to 4, a toroidal core having a high density and a high electrical resistance in parallel was obtained. In contrast, in Comparative Examples 1 and 4, due to the nanopowder made of amorphous MgO, the electrical resistance decreased. In Comparative Examples 2 and 5, probably due to easy detachment of the coating layer made of iron phosphate from the Fe—Si alloy powder or Fe—Ni—Si alloy powder, both of the resistance and the density decreased. In Comparative Examples 3 and 6, due to the nanopowder displaced outside of the coating layer, the density was insufficiently improved.

DESCRIPTION OF SYMBOLS

10: SOFT MAGNETIC IRON-BASED PARTICLE, 20: COATING LAYER, 30: NANOPOWDER, 100: COMPOSITE PARTICLE

What is claimed is:

1. A composite particle comprising:

a soft magnetic iron-based particle;

a coating layer disposed on a surface of the soft magnetic iron-based particle; and a spherical nanopowder with at least a part thereof disposed inside of the coating layer, wherein the coating layer is a layer of a compound comprising Fe, Si, O, B and N, and the nanopowder is a powder of a compound comprising O, N and at least one element selected from the group consisting of Fe, Si, Zr, Co, Al, Mg, Mn and Ni.

2. The composite particle according to claim 1, wherein the nanopowder is a powder of a compound comprising Fe, Si, O and N.

3. The composite particle according to claim 1, wherein the coating layer has an average thickness of 5 to 100 nm.

4. The composite particle according to claim 1, wherein the composite particle has an oxygen content of 0.3 mass % or less.

5. The composite particle according to claim 1, wherein the composite particle has a nitrogen content of 0.2 to 0.6 mass %.

6. The composite particle according to claim 1, wherein in an enlarged photograph of a surface of the composite particle, a proportion of a total area of the nanopowder included in the area is 1 to 5% with respect to an area of the surface of the composite particle.

7. The composite particle according to claim 1, wherein the nanopowder has an average particle size of 5 to 200 nm.

8. The composite particle according to claim 1, wherein the soft magnetic iron-based particle comprises an oxidized region along an interface to the coating layer.

9. A dust core comprising the composite particle according to claim 1.

* * * * *